US007921738B2

(12) United States Patent
Bailey et al.

(10) Patent No.: US 7,921,738 B2
(45) Date of Patent: Apr. 12, 2011

(54) DEVICE FOR IDENTIFYING THE LOCATION OF COAL ROPES

(75) Inventors: William P. Bailey, East Granby, CT (US); Richard C. LaFlesh, Suffield, CT (US); Jeffrey S. Mann, Hingham, MA (US); David H. Nilson, Granby, CT (US); Joseph W. Quinn, Bloomfield, CT (US)

(73) Assignee: ALSTOM Technology Ltd, Baden (CH)

( * ) Notice: Subject to any disclaimer, the term of this patent is extended or adjusted under 35 U.S.C. 154(b) by 283 days.

(21) Appl. No.: 12/129,715

(22) Filed: May 30, 2008

(65) Prior Publication Data

US 2009/0205544 A1 Aug. 20, 2009

Related U.S. Application Data

(60) Provisional application No. 61/029,392, filed on Feb. 18, 2008.

(51) Int. Cl.
*G01F 1/28* (2006.01)
*G01F 1/30* (2006.01)

(52) U.S. Cl. ..... 73/861.74; 73/861.73

(58) Field of Classification Search ..... None
See application file for complete search history.

(56) References Cited

U.S. PATENT DOCUMENTS 3,340,733 A * 9/1967 Lasher ..... 73/861.74
3,380,299 A * 4/1968 Seymour ..... 73/186
3,960,009 A * 6/1976 Roepke et al. ..... 73/761
4,022,061 A * 5/1977 Schendel ..... 73/861.75
4,569,232 A * 2/1986 Kim ..... 73/861.04
4,604,906 A * 8/1986 Scarpa ..... 73/861.74
4,791,818 A * 12/1988 Wilde ..... 73/861.24
4,848,926 A * 7/1989 Jenkins ..... 374/142
5,065,632 A * 11/1991 Reuter ..... 73/861.73
5,131,265 A * 7/1992 Tobin et al. ..... 73/54.23
5,282,389 A * 2/1994 Faivre et al. ..... 73/861.73
5,663,508 A * 9/1997 Sparks ..... 73/861.71
6,003,387 A * 12/1999 Larson et al. ..... 73/861.73
6,196,070 B1 * 3/2001 Piascik et al. ..... 73/861.74
6,212,958 B1 * 4/2001 Conley ..... 73/861.74
6,237,427 B1 * 5/2001 Helfrich et al. ..... 73/861.77
6,253,625 B1 * 7/2001 Samuelson et al. ..... 73/861.71
6,272,935 B1 * 8/2001 Strubbe ..... 73/861.73
6,276,218 B1 * 8/2001 Waers ..... 73/861.22
7,127,953 B1 * 10/2006 Yowell et al. ..... 73/861.74

* cited by examiner

*Primary Examiner* — Harshad Patel
(74) *Attorney, Agent, or Firm* — Robert D. Crawford

(57) ABSTRACT

An apparatus (100) operative for purposes of detecting the presence of a coal rope within a coal delivery pipe (200) is provided. The apparatus (100) includes a rod (105) that is operative to flex when struck by a coal rope that is present inside the coal delivery pipe (200), a strain gauge (115) that is operative to produce an electrical signal based upon the amount of flexing that the rod (105) is subjected to when struck by a coal rope that is present in the coal delivery pipe (200), and a processor that is operative to determine based upon the electrical signal that is received thereby from the strain gauge (115) at least one of either the location of the coal rope within the coal delivery pipe (200) or the density of the coal rope within the coal delivery pipe (200).

18 Claims, 5 Drawing Sheets

DEVICE FOR IDENTIFYING THE LOCATION OF COAL ROPES

CROSS-REFERENCE TO RELATED PATENT APPLICATION

This application claims the benefit of U.S. Provisional Application No. 61/029,392 filed Feb. 18, 2008, which incorporated herein by reference in its entirety.

FIELD OF THE INVENTION

The present invention is directed to the monitoring of the flow of a pulverized coal and air mixture within a coal delivery pipe. More specifically, the present invention is directed to an apparatus for detecting roping of the pulverized coal and air mixture in a coal delivery pipe.

BACKGROUND OF THE INVENTION

A current trend in furnace technology is that directed to the optimization of combustion efficiency and emission performance by application of tuning techniques and hardware to improve the fuel/air balance in the furnace. The intent here is to achieve as closely as possible perfectly uniform coal flow from the pulverizer to the individual burners of the furnace, i.e., to the fuel admission assemblies of the furnace, so as to thereby result in the attainment therefrom of greater combustion efficiency as well as better furnace emission performance.

Each pulverizer that is employed for purposes of supplying coal to a furnace for combustion typically is operative to supply pulverized coal to the front of each burner of a single elevation of burners. Thus, as the demand for pulverized coal increases, an additional pulverizer commonly is placed in service in order to thereby supply pulverized coal to an additional elevation of burners that are suitably provided for this purpose within that the same furnace. Similarly, as demand for pulverized coal decreases, an elevation of burners, as well as the pulverizer that is being employed to supply pulverized coal thereto, are commonly each removed from service. Typically, single furnaces, such as, by way of exemplification and not limitation tangentially fired pulverized coal furnaces in which pulverized coal that is entrained in air is designed to be fired, are designed for this purpose so as to be rectangular in cross-section and such as to have four burners per elevation. Each such burner typically is located at a respective one of the corners of the furnace. Continuing, pipes that are designed to be operative to deliver pulverized coal therethrough are suitably positioned so as to terminate at the front of each burner of the same elevation of burners. Such coal delivery pipes are designed to originate at a single one of the pulverizers. Commonly, no two coal delivery pipes that originate from the same pulverizer are found either to be of the same length or to traverse the same path.

To this end, because such coal delivery pipes are of different lengths and traverse different paths, no two coal delivery pipes embody the same pressure drop from end to end thereof. On the other hand, if a uniform pressure drop were to exist in each coal delivery pipe, this would result in a near uniform coal flow in each one of the coal delivery pipes. As such, in order thus to compensate for the differing pressure drops in the coal delivery pipes, it is known that riffles, orifices, and/or splitters, each of which being adjustable have been utilized in the prior art in association with such coal delivery pipes for purposes of effecting therewith the redirection of coal flow and/or the adjustment of pressure drops in order to thereby achieve as a result of the use thereof a balancing of coal flow among each of the coal delivery pipes. This form of methodology is often referred to in the art as coal balancing.

In order to render it possible to properly adjust such riffles, orifices, and/or splitters, it is necessary that the total coal flow in each of the coal delivery pipes be accurately measured. To this end, there are many two phase coal flow measurement devices, which are suitable for use for this purpose that are known to be commercially available. Continuing, such commercially available two phase coal flow measurement devices are known to employ a variety of different principles of operations. By way of exemplification and not limitation in this regard, some such two phase coal flow measurement devices are known to be operative to physically collect samples of pulverized coal from across each one of the coal delivery pipes and, by virtue of the subsequent weighing of such pulverized coal samples, can produce therefrom a relative indication of the pulverized coal flow through the coal delivery pipes in question. In addition there are also known to exist a variety of either two phase devices, which are operative to provide a real time indication of the pulverized coal flow through coal delivery pipes based on the use of optical, acoustic vibration, electrostatic, or microwave forms of methodologies. In this regard, such optical devices commonly use light scattering methods in order to thereby determine therefrom particle size as well as the amount of pulverized coal loading. On the other hand, acoustic vibration devices are designed to be operative to relate variations in the resonant frequency of the pulverized coal stream in the coal delivery pipes in order to thereby effect therefrom a measurement of the pulverized coal flow rate. Continuing, electrostatic sensors are designed to be operative to measure the electric charge on the pulverized coal particles in the coal delivery pipes in order to thereby produce therefrom an indication of the relative mass flow and velocity thereof. Lastly, microwave based devices are designed to be operative to employ microwave transmitters and receivers that are located in situ in order to thereby produce therefrom an indication of pulverized coal flow density as well as an inferred pulverized coal flow rate.

The two phase coal flow measurement devices that are commonly available are not only known to be expensive, but are also known to lack measurement accuracy when employed in those situations wherein considerable coal roping occurs. Continuing, it has been found that coal roping commonly creates measurement errors due to the fact that variations exist in the two-phase fluid flow density. Coal roping is generally defined as being a concentration of pulverized coal in a relatively small area of a coal delivery pipe. To this end, the pulverized coal that is entrained in the coal/air mixture, which exits from a pulverizer, is dragged by the flowing medium, causing such pulverized coal to lag insofar as changes in the flow pattern thereof is concerned, due to the configuration of the coal delivery pipe. That is, a coal rope is created as a result of the centrifugal flow patterns that are established by virtue of the elbows and pipe bends that are present in the coal delivery pipe. Continuing with the description thereof, the exact position of such a coal rope within the coal delivery pipe, as well as the size of such coal rope, will vary with time and thus the coal rope's existence cannot be accurately predicted insofar as the location thereof within the coal delivery pipe is concerned, nor can the size of such a coal rope be accurately determined. As such, the existence of such coal roping functions to prevent coal flow from being accurately measured in a coal delivery pipe. In addition, such coal roping is also operative to cause the coal balancing between various coal delivery pipes to be inexact.

Accordingly, a need has been found to exist for a new and improved apparatus (a) that is capable of being employed to measure the coal flow in a coal delivery pipe notwithstanding the presence therein of coal roping, (b) that is capable of effecting therewith a balancing of the coal flow in a coal delivery pipe notwithstanding the presence therein of coal roping, and (c) that is operative for purposes of detecting therewith the presence of a coal rope within a coal delivery pipe.

OBJECTS OF THE INVENTION

It is an object of the present invention to provide a new and improved apparatus that is capable of being employed to measure the coal flow in a coal delivery pipe.

It is also an object of the present invention to provide such a new and improved apparatus that is capable of being employed to measure the coal flow in a coal delivery pipe notwithstanding the presence therein of coal roping.

Still another object of the present invention is to provide such a new and improved apparatus that is also operative to effect therewith the balancing of the coal flow between at least two coal delivery pipes notwithstanding the presence of coal roping in one or both of said at least two coal delivery pipes.

Yet another object of the present invention is to provide such a new and improved apparatus that is capable of being employed for purposes of detecting therewith the presence of a coal rope in a coal delivery pipe.

Another object of the present invention is to provide such a new and improved apparatus that is capable of being employed for purposes of determining therewith the location of a coal rope in a coal delivery pipe.

It is also an object of the present invention to provide such a new and improved apparatus that is capable of being employed for purposes of determining therewith the size of a coal rope in a coal delivery pipe.

The above-stated objects, as well as other objects, features, and advantages, of the present invention will become readily apparent to those skilled in the art from the detailed description thereof that follows, which is to be read in conjunction with the illustration of the present invention in the appended drawings.

SUMMARY OF THE INVENTION

In accordance with the present invention, a description of and an illustration of a detector that is operative for purposes of detecting therewith a concentrated stream of pulverized coal within a pulverized coal and air mixture that is flowing through a coal delivery pipe is provided herein. Preferably, such a coal delivery pipe is positioned both downstream of a pulverizer that is designed to be operative for purposes of pulverizing coal therewith and for thereafter forming such pulverized coal into a pulverized coal and air mixture, and upstream of a furnace to which such pulverized coal and air mixture is intended to be supplied. However, such coal delivery pipe could equally well without departing from the essence of the present invention be any other type of pipe through which a pulverized coal and air mixture is intended to be made to flow. The pulverizer to which reference is made here is frequently also referred to as a mill. The detector constructed in accordance with the present invention includes at least one rod, a strain gauge associated with each such rod, and either a processor or an electronic monitor.

Each such rod of the deflector constructed in accordance with the present invention is designed to be operative for purposes of being made to extend within a coal delivery pipe. When positioned within such a coal delivery pipe, each such rod of the deflector of the present invention flexes when such rod is brought into contact with a concentrated stream of pulverized coal. That is, the concentrated stream of pulverized coal is operative to cause such a rod to bend when such concentrated stream of pulverized coal strikes such a rod. Preferably, though without departing from the essence of the present invention not necessarily, each such rod of the deflector of the present invention is made of metal. Continuing with the description herein of the deflector of the present invention, each of the strain gauges of the deflector of the present invention is designed to be operative to produce an electrical signal, which in turn is based upon a flexing of the rod of the deflector with which that strain gauge is associated. To this end, such an electrical signal is generated when the rod with which that strain gauge is associated bends.

In accordance with one alternative embodiment of the present invention, a processor, which could take the form of any type of commercially available processor that is capable of functioning in the manner that is described herein; namely, that is capable of processing each generated signal that is received thereby in order to thereby determine at least one of the following: the location and/or the density of the concentrated stream of pulverized coal. To this end, such a processor is designed to be operative to utilize the attributes of each generated signal that is received thereby in order to thereby determine the location and/or the density of the concentrated stream of pulverized coal. In accordance with another alternative embodiment of the present invention, an electronic monitor may be employed in lieu of a processor. In accordance with this alternative embodiment of the present invention, such an electronic monitor is designed to be operative to indicate the location and/or the density of the concentrated stream of pulverized coal based upon each generated electronic signal received thereby without requiring any processing thereof. To this end, such an electronic monitor is not designed to effect therewith any determination of the location and/or of the density of the concentrated stream of pulverized coal, rather such an electronic monitor is designed to merely effect therewith a representation of the electronic signal, or electronic signals received thereby.

In accordance with one aspect of the present invention, each rod of the deflector constructed in accordance with the present invention is designed to extend across an internal cross section of the coal delivery pipe in which such rod is suitably positioned. To this end, each such rod is designed so as to be capable of being made to extend within a single plane that is operative to define a cross section of the coal delivery pipe in question. In accordance with a further aspect thereof, each such rod is designed to be movable about the afore-described internal cross section of the coal delivery pipe in question. To this end, such a rod, in accordance with this aspect of the present invention, is designed not to be fixed within the coal delivery pipe in question.

In accordance with a further aspect of the present invention, the deflector constructed in accordance with the present invention is designed so as to embody only one such rod. This only one such rod is movable and includes a target disk that is suitably attached thereto. Continuing, this target disk is suitably configured so as to be capable of being struck by the concentrated stream of pulverized coal when this only one such rod is moved about the internal cross section of the coal delivery pipe in question. In accordance with yet a further aspect of the present invention, this only one such rod is suitably designed so as to be capable of being manually moved about the internal cross section of the coal delivery pipe in question.

In accordance with another aspect of the present invention, the pipe of the deflector constructed in accordance with the present invention comprises a first pipe, and preferably at least one rod that is configured so as to be capable of being extended within a second pipe that is also suitably included. In a manner similar to the rod, or rods, that are associated with the first pipe, this rod, or rods, that is designed to be associated with the second pipe is designed to be operative for purposes of flexing when brought into contact with a concentrated stream of pulverized coal. In addition, like the rod, or rods, that are associated with the first pipe, each of these rods that are associated with the second pipe also has a strain gauge associated therewith that is designed to be operative to generate an electrical signal, the latter signal being based upon a flexing of the rod associated with the strain gauge in question. In accordance with this aspect of the present invention, the processor of the deflector constructed in accordance with the present invention is designed to be operative to process each generated electrical signal that is received thereby in order to thereby determine the location and/or the density of the concentrated stream of pulverized coal that is present in the first pipe, and the location and/or the density of the concentrated stream of pulverized coal that is present in the second pipe as well.

According to still another aspect of the present invention, the at least one rod of the deflector constructed in accordance with the present invention comprises multiple rods. In a still further aspect of the present invention, such multiple rods preferably are suitable designed so as to be capable of being attached to one another in order to thereby form a single unit. Such a single unit is suitably designed for mounting within the pipe of the deflector constructed in accordance with the present invention.

In accordance with yet another aspect of the present invention, multiple strain gauges are preferably associated with each rod of the deflector constructed in accordance with the present invention. Each such one of these multiple strain gauges is designed to be operative to generate an electrical signal that is based upon a flexing of the rod with which a respective one of these multiple strain gauges is associated.

According to still another aspect of the present invention, each electrical signal that is generated is designed to embody a strength that is designed to be proportional to the amount of flexing to which the rod associated with that respective one of the multiple strain gauges is subjected. To this end, one such amount of flexing of the rod in question results in the production of an electrical signal that embodies one strength, and another such amount of flexing of the rod in question results in the production of an electrical signal that embodies another, but different, strength. In accordance with a further aspect of the present invention, a determination is made that is based upon the respective strength of each electrical signal that is generated.

In accordance with one aspect of the present invention, the concentrated stream of pulverized coal comprises a coal rope.

In accordance with another aspect of the present invention, the processor of the deflector constructed in accordance with the present invention is capable of causing the amount of the coal and air mixture that is supplied to the coal delivery pipe to be varied as a result of the determination that is made based upon the strength of the respective electrical signal that is generated. In accordance with a further aspect of the present invention, the varying of the amount of the coal and air mixture that is supplied to the coal delivery pipe is done by means of the processor of the deflector constructed in accordance with the present invention wherein an adjustment is directed from such processor to at least one of the following: an orifice, a splitter, and/or a riffle that is suitably emplaced within the coal delivery pipe. In accordance with a still further aspect of the present invention, such processor of the deflector constructed in accordance with the present invention is designed to be operative to direct an adjustment to an orifice that is suitably emplaced within the coal delivery pipe at a location upstream of the at least one rod.

In accordance with yet another aspect of the present invention, at least the location of the concentrated stream of pulverized coal in the coal delivery pipe is determined, and the processor of the deflector constructed in accordance with the present invention is designed to be operative to be capable of causing the location of such a concentrated stream of pulverized coal in the coal delivery pipe to be moved within the coal delivery pipe as a result of the determination that is made based upon the strength of the respective electrical signal that is generated. In accordance with a further aspect of the present invention, such processor is capable of causing the movement of such concentrated stream of pulverized coal in the coal delivery pipe by virtue of the directing of an adjustment therefrom to a splitter that is suitably positioned for this purpose within the coal delivery pipe at a location that is downstream of the at least one rod of the deflector constructed in accordance with the present invention.

BRIEF DESCRIPTION OF THE DRAWINGS

In order to facilitate a fuller understanding of the present invention, reference is now had herein to the appended drawings. The appended drawings are not to be construed as limiting the present invention, but rather are intended to be exemplary only of the present invention.

DETAILED DESCRIPTION OF A PREFERRED EMBODIMENT

Figure 1:
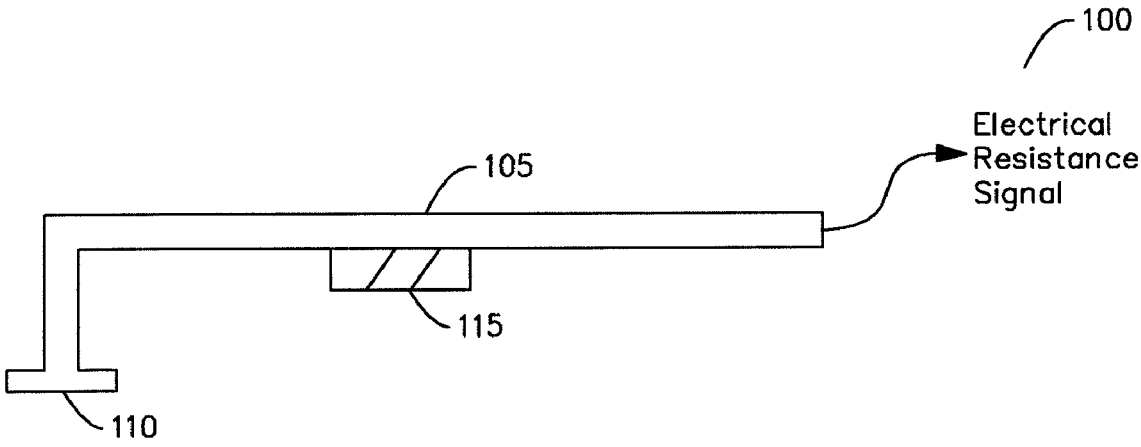
FIG. 1 is a simplified depiction of a first embodiment of a coal roping probe constructed in accordance with the present invention.

Referring to FIG. 1, a first embodiment of a coal roping probe constructed in accordance with the present invention is illustrated therein. This first embodiment of such a coal roping probe is for ease of reference thereto referred to herein as a single coal roping probe 100. Such a single coal roping probe 100 in accordance with the present invention preferably includes a flexible metal probe rod 105 that is designed to be operative for purposes of being made to extend within a coal delivery pipe such as to be located within the coal flow in that coal pipe. Preferably, the single coal roping probe 100 in accordance with the present invention is designed to be operative for purposes of being made to extend across the internal cross sectional area of the coal delivery pipe in question. Continuing with description thereof, at one end of the probe rod 105 there is positioned in accordance with the present invention a coal rope target disk 110, which without departing from the essence of the present invention may be, if so desired, made to be either integral with, or attached to, the end of the probe rod 105. With further reference thereto, on the probe rod 105 there is mounted in accordance with the preferred embodiment of the present invention at least one strain gauge 115. Such a single coal roping probe 100 without departing from the essence of the present invention can be, if so desired, made to be either installed as a component thereof in existing coal fired systems, or as a component thereof in new coal fired systems.

The probe rod 105 in accordance with the present invention is designed to be operative to flex proportionately to the density and to the velocity of a coal rope in response to the impacting thereof on to the target disk 110. The strain gauge 115, as will be understood by one of ordinary skill in the art, is designed to be of conventional construction such as to consist of one or more thin metallic foil grids that are suitably fixed directly to the probe rod 105 such that the resistance of such thin metallic foil grids will vary in direct proportion to the amount of strain, i.e., flexing, to which the probe rod 105 is subjected by the bending force that is exerted by a coal rope. Continuing with the description thereof, the strain gauge 115 preferably includes a Wheatstone bridge circuit (not shown in the Figures in the interest of maintaining clarity of illustration therein) that is designed to be operative to produce a resistance signal, which embodies a strength that is proportional to the amount of flexing to which the probe rod 105 is subjected. Such a resistance signal in accordance with the present invention is designed to be operative to indicate the relative position and size (i.e., density) of the coal rope that is in contact with the single coal roping probe 100. To this end, such a resistance signal will not be generated if the probe rod 105 is not being struck by a coal rope. On the other hand, the larger the coal rope is that is striking the probe rod 105, the larger will be the generated resistance signal. In accordance with one alternative embodiment of the present invention, a processor (not shown in FIG. 1 in the interest of maintaining clarity of illustration therein) is designed to be operative to process the output from the strain gauge 115 in order to thereby establish from such output the location and size of such a coal rope. Alternatively without departing from the essence of the present invention, and if so desired, output from the strain gauge 115 can be coupled with an electronic monitor of conventional construction (not shown in the Figures in the interest of maintaining clarity of illustration therein), which is designed to be operative to merely indicate the existence and strength of any signal, or signals, that the strain gauge 115 generates.

The single coal roping probe 100 of the present invention that is illustrated in FIG. 1 is especially suited for use as a part of temporary test equipment for purposes of manually effecting therewith the desired adjustment of coal riffle/splitter/orifice devices. Of course, the single coal roping probe 100 of the present invention that is illustrated in FIG. 1 can equally well be utilized without departing from the essence of the present invention in other ways, including by way of exemplification and not limitation as part of a permanent installation in a coal delivery pipe.

Figure 2:
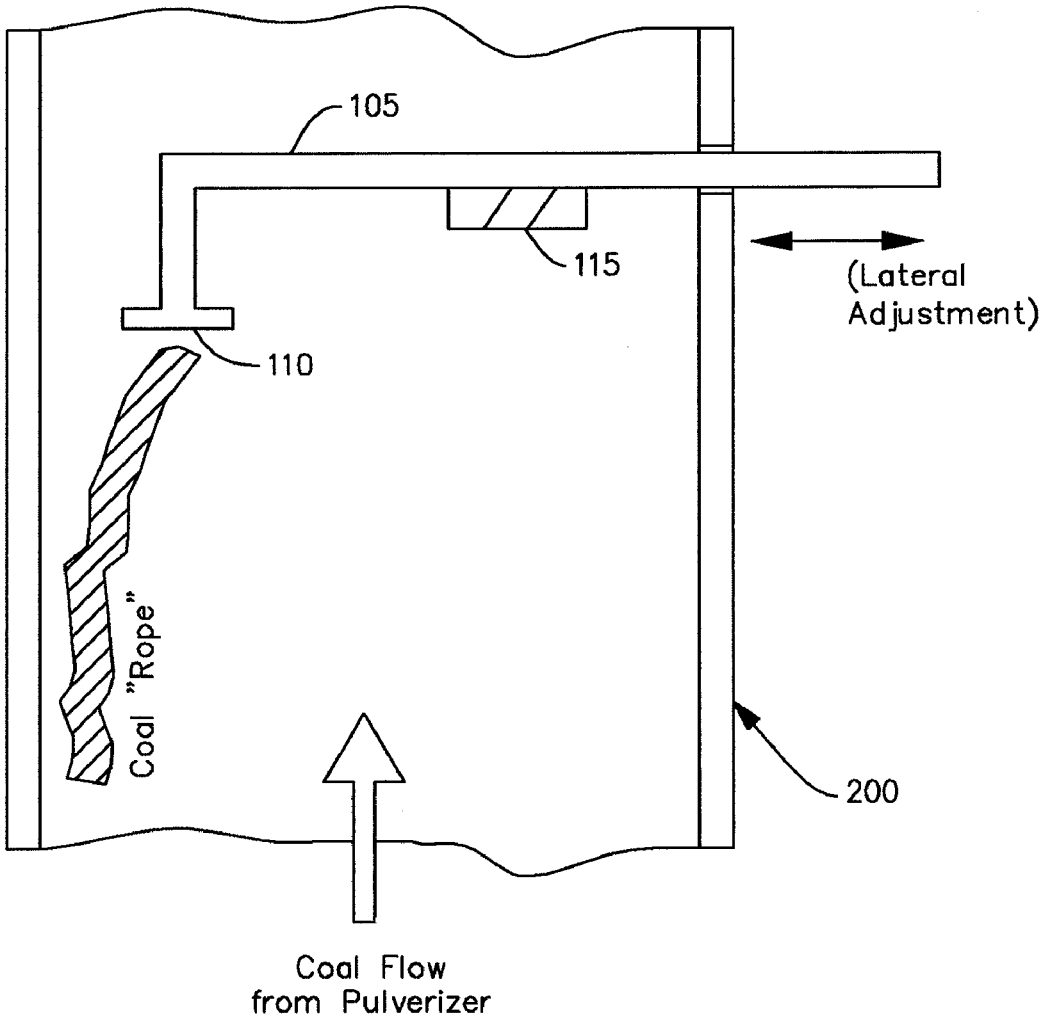
FIG. 2 depicts the first embodiment of the coal roping probe of FIG. 1 illustrated emplaced in accordance with the present invention within a coal delivery pipe in the presence of a coal rope.

FIG. 2 is a simplified depiction of the single coal roping probe 100 emplaced in accordance with the present invention within a coal pipe 200. As best understood with reference to FIG. 2, the single coal roping probe 100 is designed so as to be capable of lateral adjustment, which without departing from the essence of the present invention may be, if so desired, done either mechanically or done by hand, relative to the inside diameter of the coal delivery pipe 200. To this end, as the single coal roping probe 100 is being moved relative to the inside diameter of the coal delivery pipe 200, peaks in the strain gauge signal function to indicate the position and the size (i.e., the density) of any coal ropes that may be present within the coal delivery pipe 200.

Figure 3:
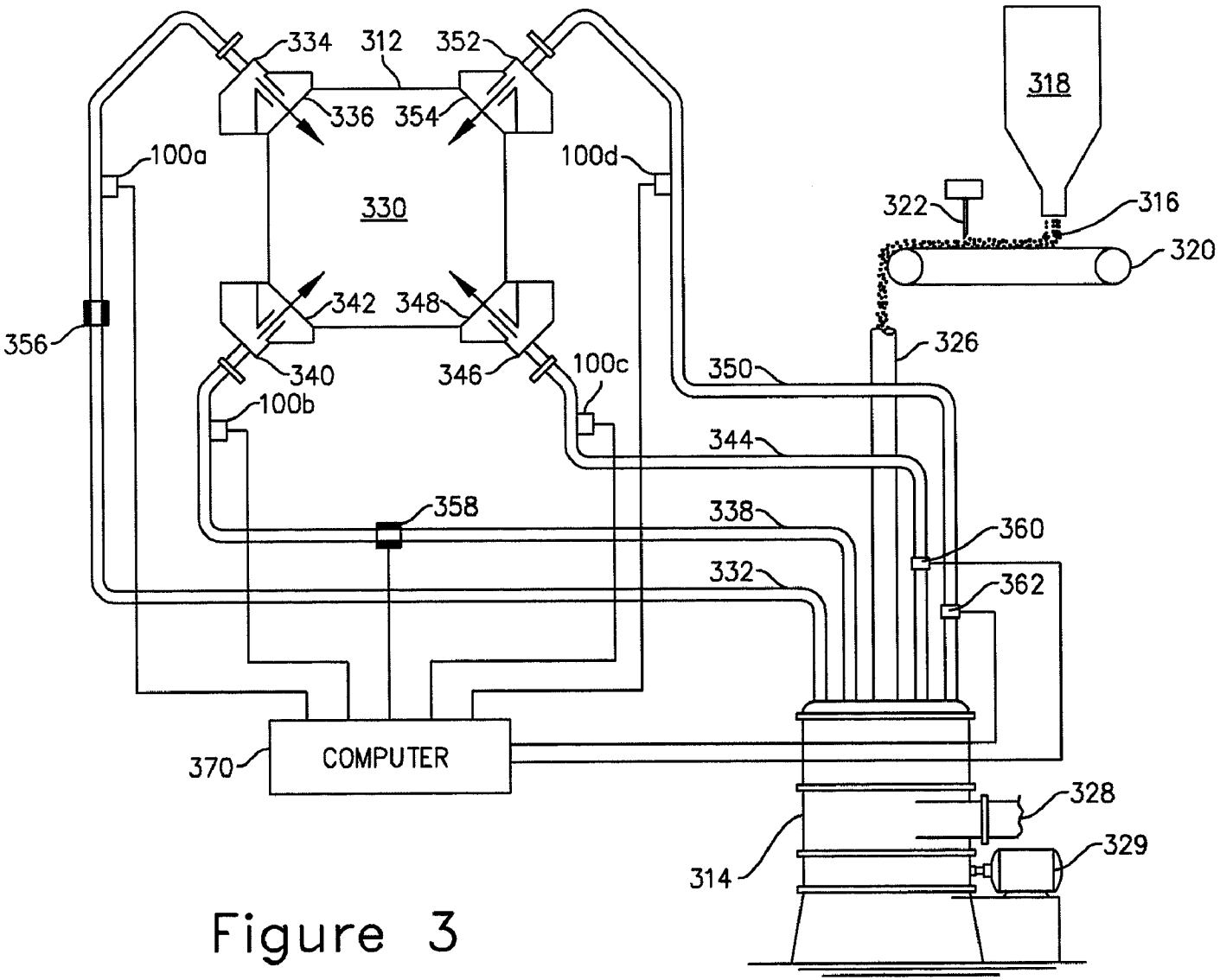
FIG. 3 is a schematic drawing of a pulverizer and associated fuel delivery pipes that are designed to be operative to supply pulverized coal to the front of an elevation of burners that are positioned along a cross-section of a pulverized coal fired furnace, including a coal roping detection system constructed in accordance with the present invention.

In FIG. 3 of the drawings there is depicted by way of exemplification and not limitation a system denoted therein by the reference numeral 300 wherein multiple single coal roping probes are employed. It will be readily understood by those skilled in the art that without departing from the essence of the present invention one or more single coal roping probes could equally well be, if so desired, installed in a system different than the system that is illustrated in FIG. 3 and that is described herein. To this end, in accordance with the system that is shown in FIG. 3, coal 316 is designed to be fed under the influence of gravity from the storage bunker 318 on to a belt feeder 320 and is then spread thereon by means of the operation of the spreader 322. The coal 316 is then made to flow from the belt feeder 320 to the inlet pipe 326 of the pulverizer 314 whereupon the coal 316 is then further fed under the influence of gravity to the interior of the pulverizer 314. Inside the pulverizer 314, the coal 316 is then made to pass between a grinding surface suitably provided therein for this purpose that is designed to be driven by the motor denoted in the drawings by the reference numeral 329 and a plurality of grinding rolls such that the coal 316 is thus pulverized to a powdery consistence in order to thereby increase the surface area of the now pulverized coal that is now available for chemical reaction during the combustion of such pulverized coal.

Continuing with the description thereof, heated air for drying and transporting the pulverized coal 316 is made to enter the pulverizer 314 through the heated air inlet 328 at a location that is beneath the grinding surface. Such heated air is then made to flow in an upwardly direction through the interior of the pulverizer 314 and in doing so the pulverized coal 316 becomes entrained therein whereupon the heated air with the pulverized coal entrained therein is conveyed to a separator, that typically is located internally within the pulverizer 314. Such a separator is designed to be operative to effect therewith the recycling of the more coarse particles of the pulverized coal 316 to the pulverizer 314 for further grinding therein. While the finer particles of the pulverized coal 316 after being made to pass through such a separator are carried along by the heated air stream and are thus transported to the coal delivery pipes that are denoted in FIG. 3 by the reference numerals 332, 338, 344, and 350, respectively, to the combustion chamber 330 of the furnace 312.

As best understood with reference to FIG. 3 of the drawings, the coal delivery pipe 332 is designed to extend between the pulverizer 314 and the burner 334 that is located at the corner 336 of an elevation of burners that is typically to be found employed in a coal fired furnace. To this end, the coal delivery pipe 332 is designed to be operative to deliver pulverized coal to the combustion chamber 330 of the furnace 312 through the burner 334. Continuing, the coal delivery pipe 338 is designed to extend between the pulverizer 314 and the burner 340 that is located at the corner 342 of an elevation of burners that is typically to be found employed in a coal fired furnace. The coal delivery pipe 338 is designed to be operative to deliver coal that has been pulverized in the pulverizer 314 to the combustion chamber 330 of the furnace 312 through the burner 340. With further reference to FIG. 3, the coal delivery pipe 344 is designed to extend between the pulverizer 314 and the burner 346 that is located at the corner 348 of an elevation of burners that is typically to be found employed in a coal fired furnace. The coal delivery pipe 344 is designed to be operative to deliver coal that has been pulverized in the pulverizer 314 to the combustion chamber 330 of the furnace 312 through the burner 346. As best understood with reference to FIG. 3, the coal delivery pipe 350 is designed to extend between the pulverizer 314 and the burner 352 that is located at the corner 354 of an elevation of burners that is typically to be found employed in a coal fired furnace. The coal delivery pipe 350 is designed to be operative to deliver pulverized coal to the combustion chamber 330 of the furnace 312 through the burner 352.

In accordance with the mode of operation of the system 300 of the present invention that is illustrated in FIG. 3, in order to detect the presence of coal roping in any one or more of the coal delivery pipes 332, 338, 344, and 350, a single coal roping probe 100 is suitably mounted on a section of each of the coal delivery pipes 332, 338, 344, and 350. To this end, as best understood with reference to FIG. 3, the letter "a" has been added to the reference numeral 100 for purposes of designating as 100*a* the probe that is associated with the coal delivery pipe 332. Similarly, the letter "b" has been added to the reference numeral 100 for purposes of designating as 100*b* the probe that is associated with the coal delivery 338. Likewise, the letter "c" has been added to the reference numeral 100 for purposes of designating as 100*c* the probe that is associated with the coal delivery pipe 344, while the letter "d" has been added to the reference numeral 100 for purposes of designating as 100*d* the probe that is associated with the coal delivery pipe 350.

Continuing with the description thereof, the single coal roping probes 100*a*, 100*b*, 100*c*, and 100*d* are each designed to be suitably positioned in various positions relative to the adjustable orifices with which each of the single coal roping probes 100*a*, 100*b*, 100*c*, and 100*d* is designed to be associated. To this end, single coal roping probe 100*a* is designed to be associated with the adjustable orifice that is denoted by the reference numeral 356. Whereas, the single coal roping probe 100*b* is designed to be associated with the adjustable orifice that is denoted by the reference numeral 358, which is located in coal delivery pipe 338. While, the single coal roping probe 100*c* is designed to be associated with the adjustable orifice that is denoted by the reference numeral 358. Lastly, the single coal roping probe 100*d* is designed to be associated with the adjustable orifice that is denoted by the reference numeral 362. Thus, a single coal roping probe 100 can be placed, if so desired, without departing from the essence of the present invention in any one of a multiple of positions within a coal delivery pipe, including positions that have not been shown in FIG. 3.

Each single one of the coal roping probes 100*a*, 100*b*, 100*c*, and 100*d* in accordance with the present invention is designed to be operative to provide an input that is based upon the detection thereby of the presence of coal roping (i.e., such input being in the form of a resistance signal) through appropriate analog to digital conversion, if such is required, to an associated computer 70. In accordance with the mode of operation of the present invention, the computer 70 is designed to be operative to control the sizing of each of the adjustable orifices 356, 358, 360, and 362 based upon the detection of the presence of coal roping by one or more of the single coal roping probes 100*a*, 100*b*, 100*c*, and 100*d*, such that a uniform pressure drop is thereby capable of being maintained across all of the coal delivery pipes 332, 338, 344, and 350. As will be appreciated by those of ordinary skill in the art, the computer 70 is capable of being programmed so as to thereby be operative to effect therewith control over each of the adjustable orifices 356, 355, 360, and 362 in any manner desired, based upon the inputs that are received by the computer 70 from the single coal roping probes 100*a*, 100*b*, 100*c*, and 100*d* including by way of exemplification and not limitation adjustments that have been tailored so as to be responsive based upon the strength, or strengths, or the various inputs that the computer 70 receives. Computer 70 can comprise any type of processor of conventional construction that is capable of functioning in the manner that has been described herein. In this regard, in accordance with one simplified example thereof, if the coal roping probe 100*a* detects the presence of a coal rope, a resistance signal will be generated by the coal roping probe 100*a* and this resistance signal will be transmitted therefrom to the computer 70. Continuing, the computer 70, in accordance with this example, upon the receipt thereby of such a resistance signal as an input thereto from the coal roping probe 100*a*, is designed to be operative to transmit a signal to the adjustable orifice 356 in order to thereby cause the orifice 356 to partially close.

As will be appreciated by those skilled in the art, without departing from the essence of the present invention a single coal roping probe 100 could equally well be employed simply to determine the presence of coal roping based upon the generation thereby of a signal by means of a wheatstone bridge, i.e., such as to not thereby be operative for purposes of functioning as the basis for control of any other device. Also, one or more single coal roping probes 100 may equally well without departing from the essence of the present invention be, if so desired, employed to effect the control over a device other than an adjustable orifice, such as, by way of exemplification but not limited to, a riffle or a splitter.

Figure 4:
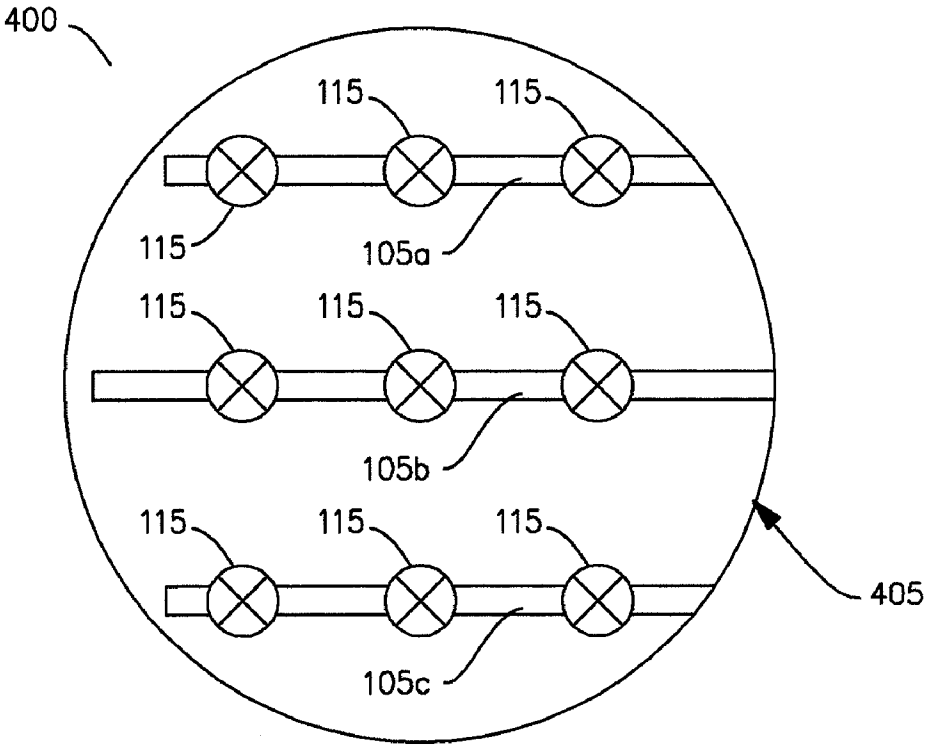
FIG. 4 is a simplified depiction of a second embodiment of a coal roping probe constructed in accordance with the present invention illustrated emplaced within a coal delivery pipe.

Referring next to FIG. 4 of the drawings, there is illustrated therein a second embodiment of a coal roping probe constructed in accordance with the present invention. To this end, this second embodiment of a coal roping probe constructed in accordance with the present invention is denoted in FIG. 4 as the grid coal roping probe 400. The grid coal roping probe 400 is capable without departing from the essence of the present invention of being, if so desired, installed either in existing coal fired systems, or in new coal fired systems. The grid coal roping probe 400, as illustrated in FIG. 4, includes multiple flexible metal probe rods that are denoted in FIG. 4 by the reference numerals 105*a*, 105*b*, and 105*c*, respectively, which are designed to be aligned across the cross sectional area 405 of each coal delivery pipe. Though three probe rods, i.e., probe rods 105*a*, 105*b*, and 105*c*, have been illustrated in FIG. 4, it should be understood that without departing from the essence of the present invention a different number of such probe rods 105 could, if so desired, equally well be employed in the grid coal roping probe 400 of the present invention. Furthermore, without departing from the essence of the present invention each of the multiple flexible metal probe rods 105*a*, 105*b*, and 105*c* may equally well be, if so desired, made to be either identical to, or different than, the flexible metal probe rod 105 to which reference has been herein previously in connection with the description and the illustration of the construction in accordance with the present invention of the first embodiment of the coal roping probe, i.e., the coal roping probe 100 of the present invention.

Whether they are identical to or different than, the flexible metal probe rod 105 that is employed in accordance with the present invention in the first embodiment of the coal roping probe 100, each of the multiple flexible metal probe rods 105*a*, 105*b*, and 105*c* is designed to be operative to flex proportionately to the density and to the velocity of a coal rope that may strike the flexible metal probe rod 105*a*, 105*b*, and 105*c*. However, in contrast to the nature of the construction of the first embodiment of coal roping probe, i.e., the coal roping probe 100, target disks are not employed in accordance with the present invention in the second embodiment of coal roping probe, i.e., the coal roping probe 400.

Continuing with the description thereof, each one of the multiple flexible metal probe rods 105*a*, 105*b*, and 105*c* is designed to be secured in place such that there is no lateral movement thereby across the inside diameter of the coal delivery pipe during the operation of the second embodiment of coal roping probe, i.e., the coal roping probe 400. If so desired, the multiple probe rods 105*a*, 105*b*, and 105*c* without departing from the essence of the present invention may be integrated together such as to thereby create therewith a single "bolt in" device so as to thereby facilitate the installation of the coal roping probe 400 in a coal delivery pipe, such as the coal delivery pipe denoted in the drawings by the reference numeral 405.

With further reference thereto, each of the multiple probe rods 105*a*, 105*b*, and 105*c* is designed to embody multiple strain gauge 115 that are attached thereto in order to thereby create therewith a multi-point grid. Though three strain gauges 115 are illustrated in FIG. 4 as being attached to each of the probe rods 105*a*, 105*b*, and 105*c*, it will be readily apparent to those skilled in the art that a different number of strain gauges 115 could without departing from the essence of the present invention equally well be attached to any one, or all, of the probe rods 105*a*, 105*b*, and 105*c* that are employed utilized in the grid coal roping probe 400 constructed in accordance with the present invention. Each of the strain gauges 115 is designed to be operative to produce a resistance signal that is designed to be proportional to the location and to the size of any coal rope that may strike the grid coal roping probe 400.

Figure 5:
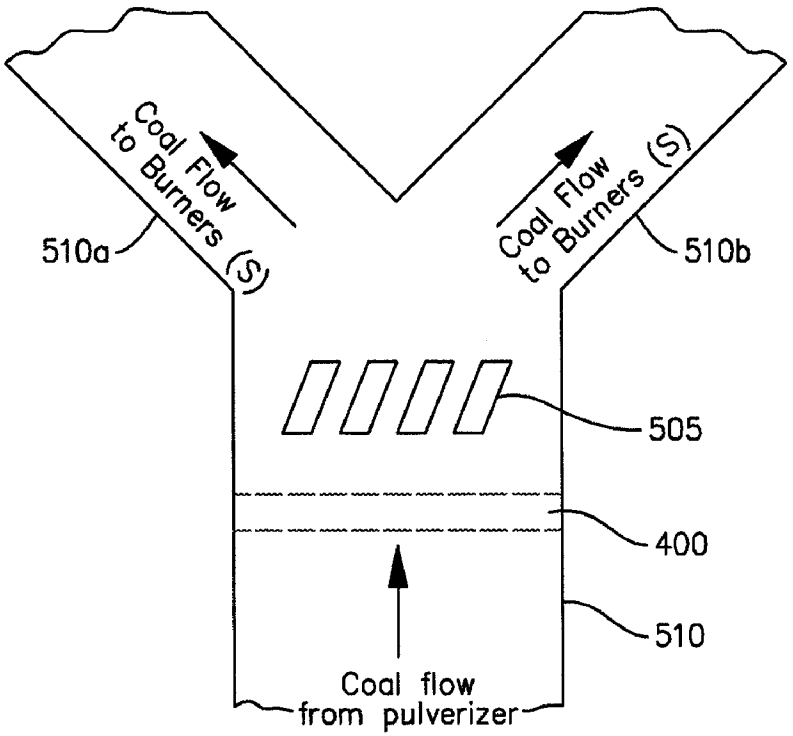
FIG. 5 depicts the second embodiment of the coal roping probe of FIG. 4 illustrated installed upstream of an adjustable riffle and/or a splitter within a coal delivery pipe in accordance with the present invention.

In FIG. 5 a grid coal roping probe 400 is illustrated as being installed upstream of an adjustable splitter 505 in a main coal pipe 510 for purposes of enabling coal stream uniformity to be optimized therewith. As described hereinbefore, the grid coal roping probe 400 constructed in accordance with the present invention may equally well be, if so desired, without departing from the essence of the present invention retrofitted into an existing coal fired system, or may be employed as a part of new construction. As illustrated in FIG. 5 the main coal pipe 510 is designed such as to be split into two smaller coal pipes that are denoted by the reference numerals 510*a* and 510*b*, at a location that is downstream of the splitter 505. To this end, the smaller coal pipe 510*a* is designed to be operative to supply pulverized coal to one or more burners, whereas the smaller coal pipe 510*b* is designed to be operative to supply pulverized coal to one or more different burners. It should be readily understood by those that are skilled in the art that a grid coal roping probe 400 constructed in accordance with the present invention could likewise be installed without departing from the essence of the present invention upstream of an adjustable riffle such as to thereby be capable of effecting control therewith over such an adjustable riffle.

In accordance with the present invention, one grid coal roping probe 400 is preferably employed with each adjustable splitter 505 (or riffle). To this end, in accordance with the mode of operation thereof as the grid coal roping probe 400 detects the presence of a coal rope in the main coal delivery pipe 510, the adjustable splitter 505 is designed to be repositioned so as to thereby be operative to effect the redirection of the coal rope based upon that detection of the coal rope by the grid coal roping probe 400. This repositioning of the adjustable splitter 505 is preferably effected by means of the same processor, which is employed for purposes of processing the resistance signals that are generated by the strain gauges 115 of the grid coal roping probe 400. To this end, such a processor is designed to be operative to generate signals through which an adjusting mechanism (not shown in FIG. 5 in the interest of maintaining clarity of illustration therein) is operated for purposes of effecting therewith the repositioning of the adjustable splitter 505. That is, in accordance with the mode of operation of such a processor after signal strengths from the various strain gauges 115 of the grid coal roping probe 400 are compared by such a processor in order to thereby determine therefrom the location of the coal rope, the processor is designed to be operative to execute a pre-established algorithm by means of which signals are generated thereby which are designed to cause electrical or pneumatic actuators to operate for purposes of effecting the repositioning of the vanes of the splitter 505 for purposes of thereby producing a more uniform flow of coal into each of the smaller coal delivery pipes 510*a* and 510*b*.

Figure 6B:
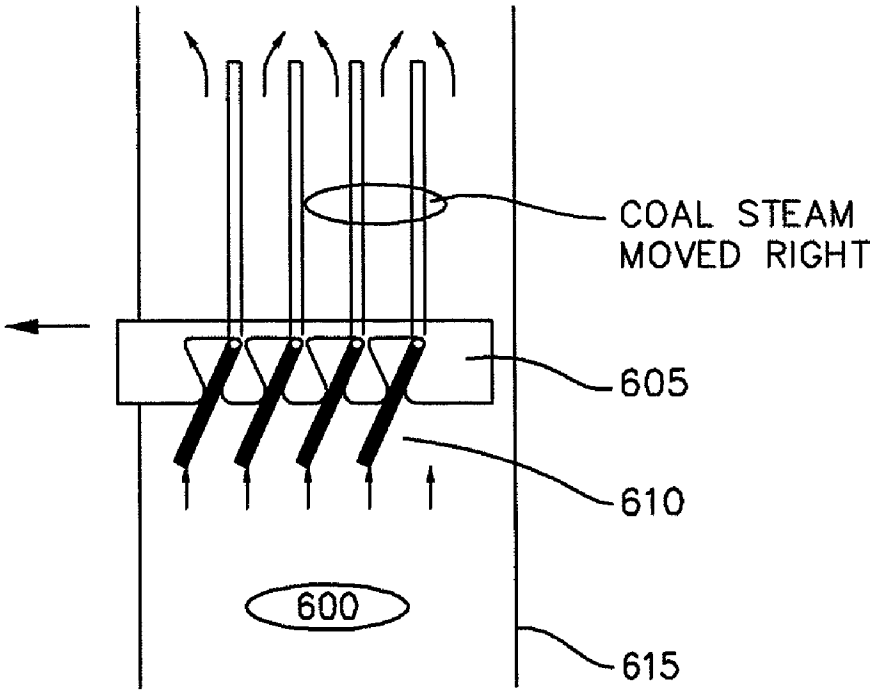
FIGS. 6*a*-6*c* each depict the repositioning in accordance with the present invention of a coal stream in a coal delivery pipe as a consequence of the operation of an adjustable riffle/splitter.
Figure 6A:
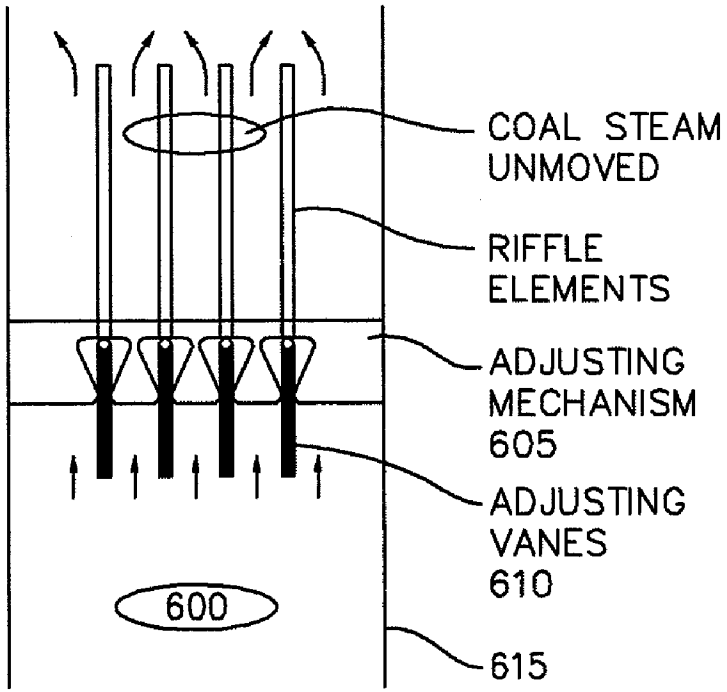
Figure 6C:
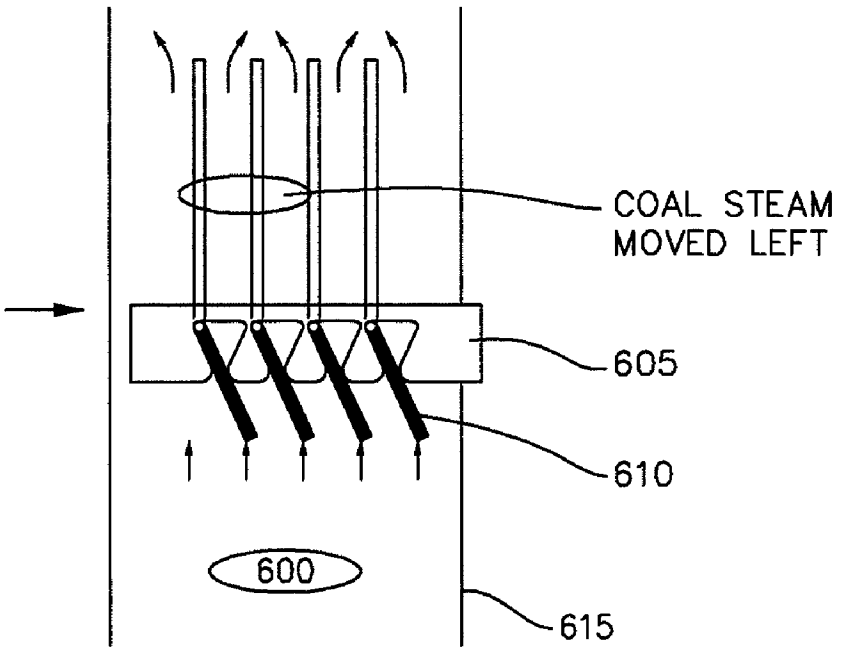

In each of FIGS. 6*a*, 6*b*, and 6*c* of the drawings there is illustrated the manner in which the repositioning of a coal stream 600 is accomplished by means of the operation of an adjustable splitter 505. In this regard, such a coal stream 600 could either be in the form of a coal rope, or such a coal stream 600 could equally well be in the form of a uniform mixture of pulverized coal and air. With reference first to FIG. 6*a*, when the adjusting mechanism 605 of a splitter occupies a neutral position, the adjusting vanes 610 are positioned so as to be parallel with the longitudinal axis of the coal delivery pipe 615. Because the adjusting vanes 610 are positioned so as to be parallel with the longitudinal axis of the coal delivery pipe 615, the position of the coal stream 600 relative to the interior of the coal delivery pipe 615 does not change as the coal stream 600 flows through the adjustable splitter 505. With reference next to FIG. 6*b*, when the adjusting mechanism 605 occupies a "left" position as viewed with reference to FIG. 6*b*, the adjusting vanes 610 are suitably turned so as to thereby be operative to cause the coal stream 600 to move toward the right as viewed with reference to FIG. 6*b* within the interior of the coal delivery pipe 615. Likewise, in FIG. 6*c* the adjusting mechanism 605 is depicted as occupying a "right" position as viewed with reference to FIG. 6*c*. When in such a "right" position, the adjusting vanes 610 are suitably turned so as to thereby be operative to cause the coal stream 600 to move toward the left as viewed with reference to FIG. 6*c* within the interior of the coal delivery pipe 615.

Figure 7:
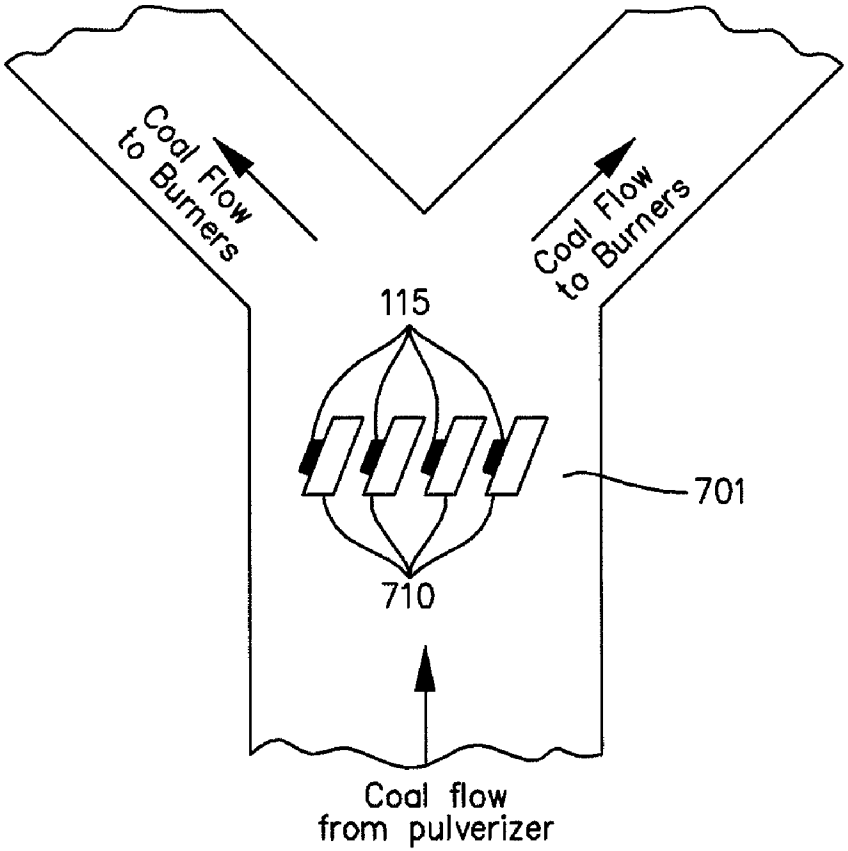
FIG. 7 is a simplified depiction of a third embodiment of a coal roping probe constructed in accordance with the present invention illustrated emplaced within a coal delivery pipe.

In FIG. 7 there is illustrated yet another embodiment of the present invention that is referred to herein as an integrated coal roping probe 701. The integrated coal roping probe 701 constructed in accordance with the present invention embodies an adjustable riffle or an adjustable splitter. Such an adjustable riffle or adjustable splitter, which the integrated coal roping probe 701 embodies may, without departing from the essence of the present invention, be either an existing adjustable riffle or an existing adjustable splitter. As such, an existing adjustable riffle or an existing adjustable splitter is thus capable of being retrofitted with an integrated coal roping probe 701 constructed in accordance with the present invention. Alternatively, without departing from the essence of the present invention a new adjustable riffle or a new adjustable splitter is equally well capable of being manufactured such as to thereby embody an integrated coal roping probe 701 constructed in accordance with the present invention.

The integrated coal roping probe 701 constructed in accordance with the present invention is designed so as to consist of at least one strain gauge 115 that is designed to be suitably attached directly to each of the adjustable angle vanes 710, and a processor (not shown in FIG. 7 in the interest of maintaining clarity of illustration therein). Such a processor, which preferably is identical in construction and in mode of operation to that, which has been discussed hereinabove in connection with the discussion of the other embodiments of the present invention, is designed to be operative for purposes of determining therewith the location and the density of a coal rope, as well as for controlling the operation of an adjusting mechanism (not shown in FIG. 7 in the interest of maintaining clarity of illustration therein) for purposes of effecting therewith the repositioning of the adjustable angle vanes 710. As will be readily apparent to those skilled in the art from the discussion set forth hereinabove, the operation of the adjusting mechanism is designed to be controlled based upon the information that is generated regarding the coal rope.

The adjustable angle vane 710, as is well known to those skilled in the art, preferably is made of metal. To this end, as a specific vane is struck by a coal rope, that vane, which is struck, will deflect. Moreover, each strain gauge 115 that is associated with the struck vane 710 will operate to generate a resistance signal based upon the amount of deflection to which the vane that is struck by the coal rope is subjected, in a manner similar to that which has been described above in connection with the discussion of the mode of operation of the probe rods 105, 105*a*, 105*b*, and 105*c*. The processor is designed to be operative to determine the location of the coal rope based upon the strongest generated resistive signal that the processor receives, as has been discussed hereinabove. The processor then is operative to effect the operation of an adjusting mechanism (not shown in FIG. 7 in the interest of maintaining clarity of illustration therein) for purposes of thereby effecting the repositioning of the adjustable riffle or the adjustable splitter.

The present invention is not intended to be limited in scope by the specific embodiments described herein. Indeed, various modifications of the present invention, in addition to those which have been specifically described herein, will be apparent to those skilled in the art based on a consideration of the foregoing description and of the accompanying drawings. To this end, such modifications are deemed to fall within the scope of the appended claims.

What is claimed is:

1. An apparatus for detecting the presence of a concentrated stream of pulverized coal within a pulverized coal and air mixture that is flowing through a coal delivery pipe having an internal cross section comprising: at least one rod that is configured so as to extend to a plurality of lateral locations within said coal delivery pipe and that is operative to flex when contacted by a concentrated stream of pulverized coal; a strain gauge operatively connected to said at least one rod so as to generate an electrical signal for the plurality of the lateral locations based upon the amount of flexing to which said at least one rod to which said strain gauge is operatively connected is subjected; and a processor operative to process each electrical signal that is generated by said strain gauge and that is received by said processor in order to thereby determine at least one of either a) a location having a highest generated electrical signal indicating a coal rope, or b) the density of the concentrated stream of pulverized coal at one or more of the plurality of lateral locations within said coal delivery pipe.

2. The apparatus as claimed in claim 1 wherein said at least one rod is further configured so as to be extending within said coal delivery having a pipe across said internal cross section of said coal delivery pipe.

3. The apparatus as claimed in claim 2 wherein said at least one rod is further configured so as to move about said internal cross section of said coal delivery pipe.

4. The apparatus as claimed in claim 3 wherein said at least one rod is a single rod, and said apparatus further comprises: a target disk attached to said single rod that is configured so as to be struck by the concentrated stream of pulverized coal as said single rod is laterally moved about said internal cross section of said coal delivery pipe.

5. The apparatus as claimed in claim 4 wherein said single rod is further configured so as to be manually moved about to the plurality of lateral locations within said internal cross section of said coal delivery pipe.

6. The apparatus as claimed in claim 1 wherein said at least one rod consists of multiple rods.

7. The apparatus as claimed in claim 6 wherein said multiple rods are attached to one another in order to thereby form a single unit for purposes of facilitating the mounting thereof within said coal delivery pipe.

8. The apparatus as claimed in claim 1 wherein: multiple strain gauges are operatively connected to said at least one rod; and each of said multiple strain gauges is operative to generate an electrical signal based upon the amount of flexing to which said at least one rod to which said multiple strain gauges are operatively connected are subjected.

9. The apparatus as claimed in claim 1 wherein: said strain gauge is further operative so as to be generating an electrical signal based upon the amount of flexing to which said at least one rod to which said strain gauge is operatively connected is subjected, said electrical signal embodying a strength that is proportional to the amount of flexing to which said at least one rod to which said strain gauge is operatively connected is subjected.

10. The apparatus as claimed in claim 9 wherein the determination made by said processor is based upon the strength of each electrical signal generated by said strain gauge that is received by said processor.

11. The apparatus as claimed in claim 1 wherein the concentrated steam of pulverized coal is a coal rope.

12. The apparatus as claimed in claim 1 wherein said processor is further operative so as to be causing an amount of the coal and air mixture that is supplied to said coal delivery pipe to be varied based upon the determination made by said processor in response to the electrical signal generated by said strain gauge that is received by said processor.

13. The apparatus as claimed in claim 12 wherein said processor is further configured so as to be operative to effect the varying of the amount of the coal and air mixture as a consequence of an adjustment being directed to at least one of either i) an orifice in said coal delivery pipe, or ii) a splitter in said coal delivery pipe, or iii) a riffle in said coal delivery pipe.

14. The apparatus as claimed in claim 12 wherein an orifice that is located upstream of said at least one rod in said coal delivery pipe is being adjusted.

15. The apparatus as claimed in claim 1 wherein: at least the location of the concentrated stream of pulverized coal is determined based upon the electrical signal generated by said strain gauge; and said processor is further configured so as to be operative to cause the location of the concentrated stream of pulverized coal to be moved within said coal delivery pipe based upon said determination of the location of the concentrated stream of pulverized coal.

16. The apparatus as claimed in claim 15 wherein said processor is further configured so as to be operative to cause the movement of the concentrated stream of pulverized coal as a consequence of an adjustment being made to a splitter that is located downstream of said at least one rod in said coal delivery pipe.

17. The apparatus as claimed in claim 1 wherein said at least one rod comprises at least one metal rod.

18. An apparatus for detecting the presence of a concentrated stream of pulverized coal within a pulverized coal and air mixture that is flowing through a coal delivery pipe comprising: a rod that is configured so as to extend to a plurality of lateral locations within said coal delivery pipe and that is operative to flex when contacted by a concentrated stream of pulverized coal; a strain gauge operatively associated with said rod so as to be generating an electrical signal embodying a strength that is proportional to the amount of flexing of the associated rod; and an electronic monitor operative to indicate at least one of either a) a location of the plurality of lateral locations having a highest electrical signal, or b) the density of the concentrated stream of pulverized coal that is present in said coal delivery pipe based upon each electrical signal generated by said strain gauge that is received by said electronic monitor.

* * * * *